US005424673A

United States Patent [19]

Edwards et al.

[11] Patent Number: 5,424,673

[45] Date of Patent: Jun. 13, 1995

[54] LCD DISPLAY PRECHARGE REGULATOR CIRCUIT

[75] Inventors: Michael W. Edwards, Houston; Scott W. Dalton, Cypress, both of Tex.

[73] Assignee: Compaq Computer Corporation, Houston, Tex.

[21] Appl. No.: 188,527

[22] Filed: Jan. 28, 1994

[51] Int. Cl.[6] ..... H01J 19/82

[52] U.S. Cl. ..... 327/530; 327/540

[58] Field of Search ..... 327/392, 398, 530, 538, 327/540, 545; 323/901, 49

[56] References Cited

U.S. PATENT DOCUMENTS

| | | | |
|---|---|---|---|
| 4,529,890 | 7/1985 | Kobayashi et al. | 307/270 |
| 4,565,960 | 1/1986 | Takata et al. | 323/317 |
| 4,617,473 | 10/1986 | Bingham | 307/66 |
| 4,686,388 | 8/1987 | Hafner | 307/296 R |
| 5,023,476 | 6/1991 | Watanabe et al. | 307/296.1 |
| 5,187,396 | 2/1993 | Armstrong, II et al. | 307/494 |
| 5,272,393 | 12/1993 | Horiguchi et al. | 307/296.6 |

*Primary Examiner*—Timothy P. Callahan
*Assistant Examiner*—Jeffrey Zweizig
*Attorney, Agent, or Firm*—Pravel, Hewitt, Kimball & Krieger

[57] ABSTRACT

An LCD precharge regulator circuit providing current directly from the input battery voltage to precharge the LCD display. A first switch activates a precharge regulator coupled to the unregulated DC input voltage, to supply the power for the initial current surge from the DC input to charge the LCD display. The precharge regulator includes a transistor and a biasing circuit. The biasing circuit initially turns the transistor fully on, but increasingly biases the transistor off as the LCD display charges to just below the operating voltage of the LCD display. A delay circuit activates a second switch after the LCD display is substantially charged, where the second switch connects the supply voltage from the DC/DC converter to the LCD display. At that point, the transistor is biased off, isolating the LCD display from the DC input voltage. Thus, the supply voltage need only sustain the charge on the LCD display after being substantially charged. Low power series resistors are provided to serve as a fuse, which fail to an open circuit condition, isolating the LCD display from high input voltage levels in the event of excessive current flowing into an overvoltage Zener diode.

14 Claims, 2 Drawing Sheets

LCD DISPLAY PRECHARGE REGULATOR CIRCUIT

BACKGROUND OF THE INVENTION

1. Field of the Invention

The present invention relates to an LCD precharge regulator circuit for charging an LCD display to reduce the power requirements of the five volt supply.

2. Description of the Related Art

As portable computer systems evolve, it is desired to decrease the size and weight of the computer system. Most portable computers receive power from an AC/DC converter, if plugged in, or from a rechargeable battery. The AC/DC converter and/or battery provides a relatively unregulated DC input voltage to a DC/DC converter, which converts the DC input voltage to the highly regulated voltage levels required by the computer system. Typical regulated voltage supply values are twelve volts (+12V), five volts (+5V) and +3.3V. The size of the DC/DC converter is related to the amount of power it must convert to maintain the regulated voltage supply levels within specified ranges when the computer demands the most current.

LCD displays are the most commonly used display panels in portable computer systems. In spite of various improvements made in the quality of LCD displays, LCD displays electrically comprise a plurality of capacitors, and thus appear as a large capacitor to a power supply. An LCD display initially requires a significant amount of current to charge its capacitance when turned on. Once charged, however, considerably less current is necessary to maintain the charge. The five volt supply is usually used to provide power to the LCD display, since LCD displays are usually designed to receive a five volt input and the five volt supply traditionally has the largest current capability. However, the five volt supply also provides power to other vital logic circuitry, which typically requires that the voltage of the five volt supply remain within certain tight voltage specifications. Any sagging of the five volt supply causes unwanted reset conditions or fatal logic errors, which would result in the loss of data. Thus, the DC/DC converter had to be designed at a relatively high power level to provide enough current to charge the LCD display without appreciable sag of the five volt supply.

Therefore, the DC/DC converter traditionally had to have a sufficient power capacity or rating to maintain the five volt supply .within specifications, even while the LCD panel was initially charging. It is desired to reduce the size, weight, cost and power requirements of the DC/DC converter while maintaining the five volt supply within specified voltage levels.

SUMMARY OF THE PRESENT INVENTION

An LCD display precharge regulator circuit according to the present invention precharges the LCD panel directly from the battery or input power before the five volt supply is connected to the LCD display. The five volt supply is only connected to the LCD display after the LCD display has been precharged, so that the five volt supply need only maintain the charge on the LCD display. This reduces the power requirements of the five volt supply, which significantly reduces the size, weight and cost of the DC/DC converter.

When the LCD display is initially turned on, the precharge regulator immediately begins to charge the LCD panel, while a delay circuit temporarily keeps the five volt supply disconnected from the LCD display. The precharge regulator is biased on until the voltage of the LCD display has reached a certain voltage level below the five volt supply, such as 4.4 volts, at which point the precharge regulator begins to self regulate. Then, the delay circuit activates a switch to connect the five volt supply to provide power to the LCD display after precharging is completed, and the precharge regulator is biased off.

In the preferred embodiment, a precharge regulator according to the present invention comprises a transistor-based regulator, which includes a biasing circuit coupled to the five volt supply. Thus, the biasing circuit allows the transistor to supply precharge current until the voltage level on the LCD display is near five volts, at which time the five volt supply turns on and begins supplying current to the LCD display.

A potential problem with such a precharge circuit is the increased likelihood of causing damage to the expensive LCD display by accidentally exposing it to high input voltage levels. For example, accidental shorting of the precharge regulator circuitry could easily expose the LCD display to excessive input voltage levels. Thus, an LCD power regulator according to the present invention further includes a built-in fuse and a Zener diode to protect the LCD display by limiting the maximum current and voltage applied to the LCD display. The Zener diode limits the maximum voltage level of the five volt supply. The fuse preferably comprises low power series resistors, which fail by open circuiting upon an excessive current surge flowing through the Zener diode, thus isolating the LCD display from the high input voltage levels. Although such a failure may require replacing of the series resistors, the regulator transistor or the Zener diode, the more expensive LCD display unit is protected.

In this manner, an LCD precharge circuit according to the present invention handles the highest current drain to charge the LCD display, so that the size, weight, cost and power requirements of the DC/DC converter may be substantially reduced. Further, the precharging circuit provides an extra safety level to protect the LCD display from excessive voltage levels.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENT

Figure 1:
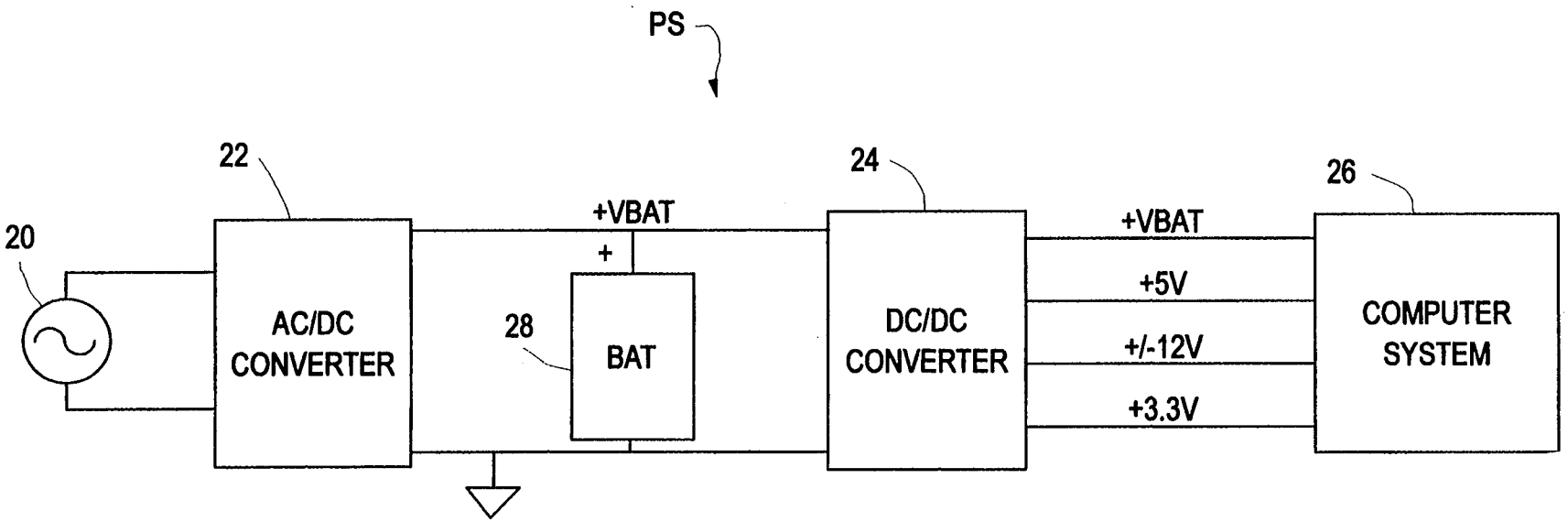
FIG. 1 is a simplified block diagram of a power supply of a portable computer system.

Referring now to FIG. 1, a simplified block diagram is shown of a power supply PS used to provide power to a portable computer system 26. In general, an AC source 20 is coupled to an AC/DC power converter 22, which converts the AC voltage to a DC voltage between a signal +VBAT and ground. The +VBAT signal preferably ranges between 12 and 18 volts. The +VBAT signal is coupled to a DC/DC converter 24, which is used to convert the +VBAT signal to the various voltage levels required by the portable computer system 26. In particular, the DC/DC converter 26 includes a positive five volt (+5V) supply, a positive twelve volt (+12V) supply, and a +3.3V supply in the preferred embodiment. Furthermore, the +VBAT signal is provided directly, or through the DC/DC converter 24, to the portable computer system 26. It is common for the DC/DC converter 24 to be contained within the same unit as the portable computer system 26.

The AC/DC power converter 22 is usually removably connected to the portable computer system 26, though it may also be integral. When the AC source 20 is not available, a battery 28 is provided and connected between the +VBAT signal and ground to provide power to the DC/DC converter 24 for the portable computer system 26. The battery 28 is preferably a rechargeable nickel cadmium (NiCD) battery or a nickel metal hydride battery (NiMH). When the battery 28 eventually discharges to a voltage level of approximately 10 to 12 volts, the AC/DC power converter 22 may be coupled to the battery 28 to recharge it. If the AC/DC power converter 22 and the battery 28 are both coupled to the DC/DC converter 24, the power converter 22 simultaneously provides power to the DC/DC converter 24 and the necessary current to charge the battery 28.

The +5V supply is connected to important logic circuitry of the computer system 26, and thus has tight voltage specifications. It is desired that the +5V supply not be loaded to the point of violating these specifications. Thus, the DC/DC converter 24 must be designed with enough power capacity to supply the maximum current necessary from the +5V supply while maintaining its voltage within the specifications.

Figure 2:
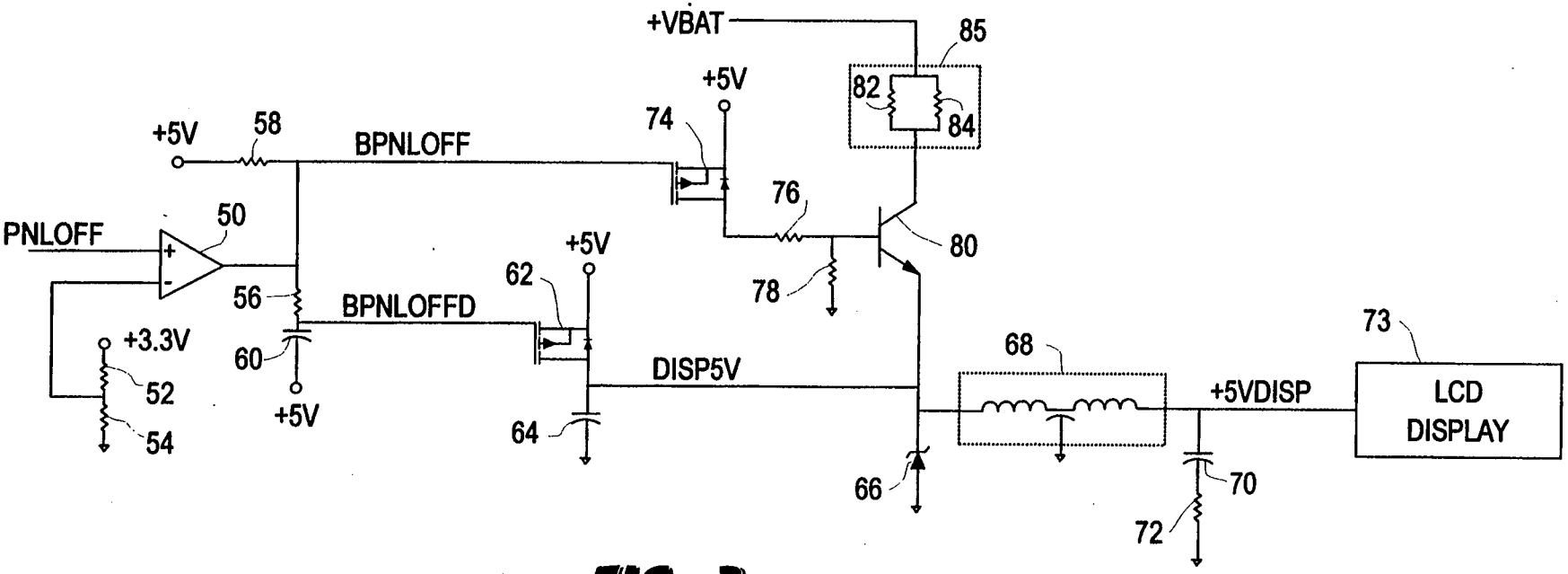
FIG. 2 is an LCD precharging circuit according to the present invention.

Referring now to FIG. 2, a schematic diagram is shown of an LCD display precharging regulator circuit according to the present invention coupled to an LCD display 73. A signal PNLOFF is provided to the positive input of a comparator 50, having its negative input coupled to one end of a resistor 52 and to one end of a resistor 54. The PNLOFF signal is provided from other circuitry in the computer system 26 to turn the LCD display 73 off to save power when the computer system is inactive. The other end of the resistor 54 is connected to ground and the other end of the resistor 52 is connected to the +3.3V supply. The output of the comparator 50 provides a signal BPNLOFF, which is provided to one end of a resistor 56 and to one end of a resistor 58. The other end of the resistor 58 is connected to the +5V supply and the other end of the resistor 56 provides a signal BPNLOFFD, which is provided to one end of a capacitor 60. The other end of the capacitor 60 is connected to the +5V supply.

The BPNLOFFD signal is provided to the gate of a P-channel enhancement MOSFET (metal-oxide semiconductor field-effect-transistor) 62, having its source connected to the +5V supply. The drain of the MOSFET 62 provides a signal DISP5V, which is provided to one end of a capacitor 64 and to the cathode of a Zener diode 66. The other end of the capacitor 64 and the anode of the Zener diode 66 are connected to ground. The Zener diode 66 preferably has a reverse breakdown voltage of 5.6 volts to provide overvoltage protection for the LCD display 73. The DISP5V signal is provided to one end of a LC filter 68 and to the emitter of an NPN bipolar transistor 80. The LC filter 68 preferably includes two series inductors with a capacitor coupled to ground. The other end of the LC filter 68 provides a signal +5VDISP, which provides power to the LCD display 73. The +5VDISP signal is connected to one end of a filter capacitor 70, having it other end connected to one end of a resistor 72. The other end of the resistor 72 is grounded.

The BPNLOFF signal is provided to the gate of another P-channel MOSFET 74, having its source connected to the +5V supply and its drain connected to one end of a resistor 76. The other end of the resistor 76 is connected to the base of the transistor 80 and to one end of a resistor 78. The other end of the resistor 78 is connected to ground and the collector of the transistor 80 is connected to one end of each of two resistors 82 and 84. The other ends of the resistors 82 and 84 receive the +VBAT signal.

The PNLOFF signal is used to turn on and off the LCD display 73 through the comparator 50. When the PNLOFF signal is asserted high, the output of the comparator 50 is open-circuited, thereby asserting the BPNLOFF and BPNLOFFD signals high and turning off the MOSFETs 74 and 62. This removes any power from the LCD display 73, turning it off. When the PNLOFF signal is negated low, the output of the comparator 50 is asserted low. The BPNLOFF signal is immediately pulled low by the comparator 50, thereby activating the MOSFET 74. The BPNLOFFD signal is not pulled low right away, however, since it is initially shorted to the +5V supply through the capacitor 60. The capacitor 60 begins to charge to 5 volts, causing the voltage across the resistor 56 to decrease until the BPNLOFFD signal falls low enough to turn on the MOSFET 62. Thus, the MOSFET 62 is turned on after a delay determined by the RC time constant defined by the resistor 56 and the capacitor 60. As will be described below, this delay is sufficient to allow a precharge circuit according to the present invention to precharge the LCD display 73. This precharge delay is approximately 10 milliseconds (ms) in the preferred embodiment, but may vary depending upon the capacitance of the LCD display 73 and the current capability of the precharge circuit.

During the precharge delay, while the MOSFET 62 is off and the MOSFET 74 is on, the +5V supply is applied across the series resistors 76, 78 through the MOSFET 74, and the DISP5V signal is still about zero volts. The resistors 82, 84 preferably have a small resistance value, so that the +VBAT signal is essentially applied to the collector of the transistor 80. The resistors 76, 78 bias the base of the transistor 80 to about 5 volts, turning it fully on. A significant amount of current is provided from the +VBAT signal to charge the capacitance of the LCD display 73 through the LC filter 68. As the LCD display 73 charges, the voltage level of the DISP5V signal begins to rise, which increasingly biases the transistor 80 off. Eventually, the LCD display 73 almost completely charges when the voltage of the DISP5V and +5VDISP signals reach approximately 4.4 volts. Preferably, this occurs before the precharge delay has expired, and thus before the MOSFET 62 is turned on.

The precharge delay expires and the voltage of the BPNLOFFD signal drops low enough to turn on the MOSFET 62 while the voltage of the DISP5V signal is still above 4 volts. When the MOSFET 62 is turned on, it pulls the DISP5V signal up towards five volts, which turns off the transistor 80. When turned off, the transistor 80 isolates the LCD display 73 from the high voltage of the +VBAT signal. The +5V supply is then applied to the DISP5V and +5VDISP signals through the MOSFET 62. The +5V supply completes the charging of the LCD display 73, if necessary, which typically requires only a relatively minor amount of current.

Thereafter, the +5V supply need only provide enough current to maintain the charge on the LCD display 73. Since the +5V supply is not applied to the LCD display 73 until after it has been substantially charged, the DC/DC converter 24 need not be designed with the power capacity to maintain the +5V supply within specification while fully charging the LCD display 73. Thus, the DC/DC converter 24 has a much smaller power capacity, allowing a smaller, lighter and less expensive design that generates less heat. Furthermore, there is very little risk of any appreciable sagging of the voltage of the +5V supply.

The circuitry of the transistor 80 receiving the +VBAT signal might otherwise cause serious damage to the LCD display 73, which is typically very expensive. If the transistor 80 should short, or if the Zener diode 66 should fail, the +VBAT signal may accidentally be provided directly to the LCD display 73. This could destroy the LCD display 73. To this end, the resistors 82 and 84 are preferably approximately one (1) ohm, 1/16th watt resistors serving as a fuse 85 to protect the LCD display 73. Thus, the fuse 85 preferably has a maximum power rating of approximately ⅛ watt. The resistors 82 and 84 also have sufficient surge current capacity to withstand the initial current through the transistor 80 when the LCD display 73 is initially turned on. If an excessive current through the fuse 85 is sustained long enough to violate its power rating, it fails to an open circuit condition. Thus, in the case of a failed condition, the resistors 82, 84 open-circuit and isolate the +VBAT signal from the LCD display 73.

It can now be appreciated that the LCD precharge regulator circuit according to the present invention uses the input voltage from the battery 28 or the AC/DC power converter 22 to precharge the LCD display 73 before the +5V supply is provided to it. This prevents the initial and significant current surge from being supplied by the +5V supply, and ultimately, by the DC/DC converter 24. The +5V supply need only have a sufficient current capacity to maintain the charge of the LCD display 73 and to keep the +5V supply within its specified voltage range. The DC/DC converter 24 is preferably designed at a significantly lower power rating, so that it may be smaller, lighter, less expensive and will generate much less heat. Furthermore, low power resistors serve as a fuse to isolate the high voltage +VBAT signal from the LCD display 73 in the event of failure of the components.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

What is claimed is:

1. A computer system having an LCD display designed to operate at a predetermined voltage level and an LCD power signal to turn on the LCD display, the computer system comprising:

means for providing an unregulated DC input voltage;

means coupled to said unregulated DC input voltage providing means for converting said unregulated DC input voltage to a regulated supply signal having a voltage approximately equal to the predetermined voltage level;

a transistor having a current path and a control input, wherein said current path is coupled between said unregulated DC input voltage and the LCD display;

a first switch having a control terminal receiving the LCD power signal and a current path having two ends, where one end is coupled to said regulated supply signal, wherein said first switch is turned on when the LCD power signal indicates that the LCD display is to be turned on;

a biasing circuit coupled between the other end of said first switch current path and ground and having a junction coupled to said control terminal of said transistor, for biasing said transistor on when said first switch is on and while the voltage of the LCD display is below the predetermined voltage level, and for biasing said transistor off when the voltage of the LCD display reaches the predetermined voltage level;

a second switch having a control terminal and a current path coupled between said regulated supply signal and the LCD display; and a delay circuit receiving the LCD power signal and coupled to said control terminal of said second switch for activating said second switch after a precharge delay from when the LCD power signal indicates the LCD display is to be turned on, wherein said second switch applies said regulated supply signal to the LCD display when turned on.

2. The computer system of claim 1, wherein the predetermined voltage level is approximately 5 volts.

3. The computer system of claim 1, wherein said unregulated DC input voltage providing means comprises an AC/DC power converter.

4. The computer system of claim 1, wherein said unregulated DC input voltage providing means comprises a battery.

5. The computer system of claim 1, wherein said unregulated DC input voltage has a voltage level ranging from 12 to 18 volts.

6. The computer system of claim 1, wherein said converting means comprises a DC/DC converter.

7. The computer system of claim 1, wherein said first and second switches each include MOSFETs.

8. The computer system of claim 1, wherein said transistor includes an NPN bipolar transistor.

9. The computer system of claim 1, wherein said biasing circuit includes a resistive voltage divider.

10. The computer system of claim 1, further comprising:

a fuse coupled between said unregulated DC input voltage and said transistor, wherein said fuse fails open if an excess of current flows through said fuse.

11. The computer system of claim 10, wherein said fuse includes a low power resistor.

12. The computer system of claim 10, wherein said fuse has a power rating of one-eighth watt.

13. The computer system of claim 10, wherein said fuse comprises two low power resistors coupled in parallel.

14. The computer system of claim 13, wherein each one of said low power resistors has a power rating of 1/16 watt.

* * * * *